US007677712B2

(12) United States Patent
Ishizawa et al.

(10) Patent No.: US 7,677,712 B2
(45) Date of Patent: Mar. 16, 2010

(54) LIQUID CONTAINER HAVING FOLDABLE PORTION

(75) Inventors: Taku Ishizawa, Nagano (JP); Takeo Seino, Nagano (JP); Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 376 days.

(21) Appl. No.: 10/912,876

(22) Filed: Aug. 6, 2004

(65) Prior Publication Data

US 2005/0057625 A1 Mar. 17, 2005

(30) Foreign Application Priority Data

Aug. 8, 2003 (JP) ..... 2003-290826
Aug. 8, 2003 (JP) ..... 2003-290829

(51) Int. Cl.
*B41J 2/175* (2006.01)

(52) U.S. Cl. ..... 347/86; 347/85

(58) Field of Classification Search ..... 347/84–87; 383/107, 120, 80, 67, 104
See application file for complete search history.

(56) References Cited

U.S. PATENT DOCUMENTS 4,719,475 A * 1/1988 Kiyohara et al. ..... 347/86
5,611,461 A * 3/1997 Kubota et al. ..... 222/105
6,151,039 A * 11/2000 Hmelar et al. ..... 347/7
6,220,702 B1 * 4/2001 Nakamura et al. ..... 347/86
6,302,530 B1 10/2001 Shimada et al.
6,505,924 B2 1/2003 Shimizu
6,609,789 B1 * 8/2003 Hunt ..... 347/86
6,655,837 B2 * 12/2003 Matsuda et al. ..... 383/38
6,786,584 B2 9/2004 Kaga et al.
D527,278 S * 8/2006 Ueda ..... D9/702
D528,011 S * 9/2006 Ueda ..... D9/702
2002/0113852 A1 * 8/2002 Kimura et al. ..... 347/85
2003/0067522 A1 * 4/2003 Kaga et al. ..... 347/86
2003/0068102 A1 * 4/2003 Matsuda et al. ..... 383/38

FOREIGN PATENT DOCUMENTS

DE 41 04 786 A1 9/1991

(Continued)

OTHER PUBLICATIONS

European Search Report from European patent appln. No. 04018836.9-1251 (Aug. 24, 2007).

*Primary Examiner*—Stephen D Meier
*Assistant Examiner*—Rene Garcia, Jr.
(74) *Attorney, Agent, or Firm*—Stroock & Stroock & Lavan LLP

(57) ABSTRACT

In an ink pack 24 stored in an ink cartridge 20 of a printer, a first welded portion is formed by bonding both end portions of a sheet of film to each other. A tube-shaped bag portion 31 is formed by the first welded portion. One opening of the bag portion 31 is thermally welded in a state where a supply member 27 is inserted into the film, thereby forming a second welded portion 38. The other opening of the bag portion is sealed through the thermal adhesion, thereby forming a third welded portion 39. The ink volume capable of being stored in the bag portion 31 of the ink pack 24 is larger than the volume in a frame 26*c* for storing the ink pack 24.

5 Claims, 10 Drawing Sheets

FOREIGN PATENT DOCUMENTS

| | | | |
|---|---|---|---|
| EP | 0 533 198 | A2 | 3/1993 |
| EP | 1 013 449 | A2 | 6/2000 |
| EP | 1 375 161 | A2 | 1/2004 |
| EP | 1 391 308 | A1 | 2/2004 |
| JP | 1-141751 | A | 6/1989 |
| JP | 06-045736 | | 2/1994 |
| JP | 10-235890 | | 9/1998 |
| JP | 11-147547 | A | 6/1999 |
| JP | 2000-103078 | | 4/2000 |
| JP | 2000-238291 | | 9/2000 |
| JP | 2000-296626 | A | 10/2000 |
| JP | 2001-205819 | A | 7/2001 |
| JP | 2001-232812 | A | 8/2001 |
| JP | 2003-118131 | | 4/2003 |
| JP | 2003-118132 | | 4/2003 |
| JP | 2003-231274 | | 8/2003 |

* cited by examiner

LIQUID CONTAINER HAVING FOLDABLE PORTION

BACKGROUND OF THE INVENTION

The present invention relates to a liquid container.

Typically, liquid ejecting apparatuses comprise liquid containers and liquid ejecting heads, ejects liquids fed from the liquid containers through the liquid ejecting heads, eject the liquid to targets facing the corresponding liquid ejecting heads. Examples of such liquid ejecting apparatuses include inkjet recording apparatuses.

An inkjet recording apparatus comprises a carriage, a recording head as a liquid ejecting head mounted on the carriage, and an ink cartridge as a liquid container. By supplying ink to the recording head from the ink cartridge and ejecting the ink from a nozzle formed in the recording head while relatively moving the carriage with respect to a recording medium as a target, the printing is performed on the recording medium.

In order to reduce the load for the carriage or decrease the size or the thickness of the apparatus, there is an inkjet recording apparatus (so-called off carriage type) in which the ink cartridge is not mounted on the carriage. Such an ink cartridge comprises an ink pack for receiving ink and a case for housing the ink pack.

An example of such an ink pack includes the ink pack 50 shown in FIG. 13. The ink pack 50 is formed in a bag shape by thermally welding four sides of two sheets of films 51, 52 to each other. The example of such an ink pack includes the ink pack 53 shown in FIG. 14. The ink pack 53 is formed in a bag shape, for example, by thermally welding the respective sides of four sheets of films 54 to 57 each other (for example, see Patent Document 1). The ink packs 50, 53 have welded portions E at which the respective sides are thermally welded each other, and have a bag shape by the welded portions E.

Patent Document 1: Japanese Unexamined Patent Application Publication No. 2000-238291

However, in the above-mentioned ink packs 50, 53, the welded portions E are protruded outwardly from the bag-shaped portions in which ink is stored. For example in the ink pack 53 formed from four sheets of films 54 to 57, the welded portions E shown by the two-dotted line in FIG. 11 are protruded in a width direction from the bag-shaped portion, and the respective welded portions E are protruded outwardly from a supply port side and a bottom portion side. For this reason, the length, the width, or the height of the ink pack is increased, and as a result, it may be necessary to secure a space for housing the welded portions E in the case. Alternatively, the ink storing volume may be reduced due to the restriction in the size of the case itself. Recently, since decrease in size of ink cartridges has been required to accommodate decreasing size of apparatuses, it is necessary to decrease the size of the cases while increasing the ink volume of the ink cartridges.

It is an object of the present invention to provide a liquid container capable of enhancing the ratio of a case occupied by the liquid volume.

It is another object of the present invention to provide a liquid storing bag capable of being decreased in size without decreasing the volume of a stored liquid, a liquid container for housing the liquid storing bag, and a method of manufacturing the liquid storing bag.

SUMMARY OF THE INVENTION

According to an aspect of the present invention, there is provided a liquid container comprising a liquid storing pack having a liquid outlet portion through which the liquid can be fed outwardly and a liquid storing bag portion made by a film and in fluid communication with the liquid outlet portion, the liquid storing pack being stored in a pack storage portion of a case, wherein a volume of the liquid capable of being stored in the liquid storing pack is larger than a volume of the pack storage portion provided inside the case.

According to this construction, since the volume of the liquid capable of being stored in the liquid storing pack is larger than the volume of the pack storage portion provided inside the case, the internal pressure of the liquid storing pack can be kept relatively small, even if the liquid has the volume substantially equal to the volume of the pack storage portion. For this reason, the liquid storing pack can be curved or bent, so that the liquid storing pack can be stored correspondingly to the shape of the pack storage portion. Therefore, since an unnecessary space in the pack storage portion can be reduced, it is possible to allow the liquid container to efficiently store the liquid. Specifically, when the liquid storing pack is filled with the liquid after the liquid storing pack is stored in the pack storage portion provided inside the case, the liquid storing pack is expanded to correspond to the shape of the pack storage portion flexibly with the filling of the liquid, so that it is possible to markedly enhance the volume efficiency in the pack storage portion.

In the liquid container, the liquid outlet portion may be protruded from the liquid storing bag portion and the volume of the liquid capable of being stored in the liquid storing bag portion may be larger than the volume of a bag storage portion provided inside the case.

According to this construction, since the liquid volume capable of being stored in the liquid storing bag portion is larger than the volume of the bag storage portion provided inside the case, it is possible to relatively decrease the internal pressure of the liquid storing bag portion, even if the liquid has almost the same volume as the volume of the bag storage portion. For this reason, the liquid storing bag portion can be curved or bent, so that the liquid storing bag portion can be stored in the bag storage portion correspondingly to the shape of the bag storage portion. Therefore, since an unnecessary space inside the bag storage portion can be reduced, it is possible to allow the liquid container to efficiently store the liquid.

In the liquid container, the liquid storing bag portion of the liquid storing pack may comprise a first sealing portion at which both end portions of one sheet of the film are bonded to each other, a body portion formed in a tube shape by the first sealing portion, a second sealing portion at which one opening of the body portion is sealed in a state where the liquid outlet portion is disposed inwardly of the one opening and which holds the liquid outlet portion, and a third sealing portion at which the other opening of the body portion is sealed.

According to this construction, the liquid storing bag portion of the liquid storing pack comprises the first sealing portion at which both end portions of the film are bonded to each other. In addition, the liquid storing bag portion further comprises the body portion formed in a tube shape by the first sealing portion, the second sealing portion at which one opening of the body portion is sealed, and the third sealing portion at which the other opening is sealed. That is, since the liquid storing bag portion is formed in a bag shape by bending a sheet of film in a tube shape and then sealing two openings in place of bonding the ends of a plurality of films to each other to form a bag shape, the sealing portions protruded outwardly from the liquid storing bag portion can be formed relatively small. For this reason, in the case, since the volume to be secured for the sealing portions can be reduced and the space for receiving the liquid can be increased, it is possible to efficiently store the liquid storing pack.

In the liquid container, a foldable portion (preferably, a gusset portion) formed by folding the body portion along a longitudinal direction may be provided as a side surface of the tube-shaped body portion.

According to this construction, since the foldable portion is provided in the body portion of the liquid storing bag portion, the liquid volume capable of being stored in the liquid storing bag portion can be increased. Since the foldable portion is formed by folding the body portion in place of forming the foldable portion by bonding another film to the body portion, a sealing portion protruded outwardly is not newly formed.

According to another aspect of the present invention, there is provided a liquid container comprising a liquid storing pack having a liquid outlet portion through which liquid can be fed outwardly and a liquid storing portion made by a film and in fluid communication with the liquid outlet portion, the liquid storing pack being stored in a pack storage portion of a case, in which a length of the liquid storing pack is larger than a length of the pack storage portion provided inside the case.

According to this construction, the length of the liquid storing pack is larger than the length of the pack storage portion provided inside the case. For this reason, the liquid storing pack stored in the pack storage portion can be bent in the longitudinal direction in the pack storage portion, so that the liquid storing pack can be stored in the pack storage portion correspondingly to the shape of the pack storage portion. Therefore, since an unnecessary space in the pack storage portion can be reduced, it is possible to efficiently store the liquid storing pack.

In the liquid container, the liquid outlet portion may be protruded from the liquid storing bag portion and the length of the liquid storing bag portion may be larger than the length of a bag storage portion provided inside the case.

According to this construction, the length of the liquid storing bag portion is larger than the length of the bag storage portion provided inside the case. For this reason, the liquid storing bag portion stored in the bag storage portion can be bent in the longitudinal direction in the bag storage portion, so that the liquid storing bag portion can be stored in the bag storage portion correspondingly to the shape of the bag storage portion. Therefore, since an unnecessary space in the bag storage portion can be reduced, it is possible to efficiently store the liquid storing pack.

In the liquid container, a foldable portion (preferably, a gusset portion) formed by folding the side surface of the liquid storing bag portion along a longitudinal direction may be provided in the liquid storing bag portion.

According to this construction, since the foldable portion is provided in the liquid storing bag portion, the liquid volume capable of being stored in the liquid storing bag portion can be increased. Since the foldable portion is formed by folding the body portion in place of forming the foldable portion by bonding another film to the body portion, a sealing portion protruded outwardly is not newly formed.

According to another aspect of the present invention, there is provided a liquid container comprising a liquid storing pack having a liquid outlet portion through which liquid can be fed outwardly and a liquid storing bag portion made by a film and in fluid communication with the liquid outlet portion, the liquid storing pack being stored in a pack storage portion of a case, in which a width of the liquid storing pack may be larger than a width of the pack storage portion provided inside the case.

According to this construction, the width of the liquid storing pack is larger than the width of the pack storage portion provided inside the case. For this reason, the liquid storing pack stored in the pack storage portion can be bent in the lateral direction in the pack storage portion, so that the liquid storing pack can be stored in the pack storage portion correspondingly to the shape of the pack storage portion. Therefore, since an unnecessary space in the pack storage portion can be reduced, it is possible to efficiently store the liquid storing pack.

In the liquid container, the liquid storing bag portion of the liquid storing pack may comprise a first sealing portion at which both end portions of one sheet of film are bonded each other, a body portion bent in a lateral direction and formed in a tube shape by the first sealing portion, a second sealing portion at which one opening of the body portion is sealed in a state where the liquid outlet portion is disposed inwardly of the one opening to hold the liquid outlet portion, and a third sealing portion at which the other opening of the body portion is sealed.

According to this construction, the liquid storing bag portion comprises the first sealing portion at which both end portions of the film are bonded to each other in addition, the liquid storing bag portion further comprises the body portion bent in a lateral direction and formed in a tube shape by the first sealing portion, the second sealing portion at which one opening of the body portion is sealed, and the third sealing portion at which the other opening is sealed. That is, since the liquid storing bag portion is formed in a bag shape by bending the film in a tube shape and then sealing two openings thereof, the sealing portions protruded in the lateral direction can be removed. For this reason, since it is not necessary to secure a space for housing the sealing portions in the lateral direction of the bag storage portion, an unnecessary space in the case can be reduced, so that it is possible to efficiently store the liquid storing pack.

In the liquid container, a foldable portion (preferably, a gusset portion) formed by folding the body portion along a longitudinal direction may be provided as a side surface of the tube-shaped body portion.

According to this construction, since the foldable portion is provided in the body portion of the liquid storing bag portion, the liquid volume capable of being stored in the liquid storing bag portion can be increased. Since the foldable portion is formed by folding the body portion along the longitudinal direction in place of forming the foldable portion by bonding another film to the body portion, a sealing portion protruded outwardly is not newly formed.

According to another aspect of the present invention, there is provided a liquid container comprising a liquid storing pack having a liquid outlet portion through which liquid can be fed outwardly and a liquid storing bag portion made by a film and in fluid communication with the liquid outlet portion, the liquid storing pack being stored in a pack storage portion of a case, in which the height of the liquid storing pack may be larger than the height of the pack storage portion provided inside the case.

According to this construction, the height of the liquid storing pack is larger than the height of the pack storage portion provided inside the case. For this reason, the liquid storing pack stored in the pack storage portion can be bent in the vertical direction in the pack storage portion, so that the liquid storing pack can be stored in the pack storage portion correspondingly to the shape of the pack storage portion. Therefore, since an unnecessary space in the pack storage portion can be reduced, it is possible to efficiently store the liquid storing pack.

In the liquid container, the liquid outlet portion may be protruded from the liquid storing bag portion and the maximum height of the liquid storing bag portion may be larger than the height of a bag storage portion provided inside the case.

According to this construction, the maximum height of the liquid storing bag portion is larger than the height of the bag storage portion provided inside the case. For this reason, the liquid storing bag portion stored in the bag storage portion can be bent in the vertical direction in the bag storage portion, so that the liquid storing bag portion can be stored in the bag storage portion correspondingly to the shape of the bag storage portion. Therefore, since an unnecessary space in the bag storage portion can be reduced, it is possible to efficiently store the liquid storing pack.

In the liquid container, a foldable portion (preferably, a gusset portion) which is formed by folding the side surface of the liquid storing bag along a longitudinal direction and which can be folded and developed in a vertical direction may be provided to the liquid storing bag portion.

According to this construction, since the foldable portion which can be folded and developed in the vertical direction is provided to the liquid storing bag portion, the liquid storing bag portion stored in the bag storage portion can vary its height in the bag storage portion. Therefore, since the height of the liquid storing bag portion can be allowed to correspond to the height of the bag storage portion, it is possible to efficiently store the liquid storing pack.

In the liquid container, a support for supporting the liquid storing pack may be formed on an inner surface of the case.

According to this construction, the support for supporting the liquid storing pack is formed on the inner surface of the case. Therefore, even when the liquid storing pack is curved or bent in the pack storage portion, the liquid storing pack does not become unstable.

According to another aspect of the present invention, there is provided a liquid storing pack having a liquid outlet portion through which liquid can be fed outwardly and a liquid storing bag portion made by a film and in fluid communication with the liquid outlet portion, wherein the liquid storing bag portion comprises a first sealing portion at which both end portions of one sheet of film are bonded to each other, a body portion formed in a tube shape by the first sealing portion, a second sealing portion at which one opening of the body portion is sealed in a state where the liquid outlet portion is disposed inwardly of the one opening to hold the liquid outlet portion, and a third sealing portion at which the other opening of the body portion is sealed.

According to this construction, the first sealing portion at which both end portions of the film are bonded to each other is formed in the liquid storing bag portion. In addition, the second sealing portion at which one opening of the body portion formed in a tube shape by the first sealing portion is sealed, and the third sealing portion at which the other opening of the body portion is sealed are formed in the liquid storing bag portion. Therefore, the liquid storing bag portion is formed in a bag shape by bending the film in a tube shape and then sealing two openings, in place of bonding the ends of a plurality of films to each other to form a bag shape. As a result, the sealing portions provided in the body portion can be smaller than those of the bag formed by bonding a plurality of films. That is, since the sealing portions protruded outwardly from the liquid storing bag portion can be reduced, it is possible to decrease the size of the liquid storing pack without decreasing the liquid volume. Further, since the sealing portions are reduced, it is possible to simplify the process of sealing the end portions of the liquid storing bag portion.

In the liquid storing bag, a foldable portion (preferably, a gusset portion) formed by folding the body portion along a longitudinal direction may be provided as a side surface of the tube-shaped body portion.

According to this construction, since the foldable portion formed by folding the body portion along the longitudinal direction is provided in the tube-shaped body portion, the liquid volume of the liquid storing bag portion can be increased. Since the foldable portion is formed by folding the body portion in place of forming the foldable portion by bonding another film to the body portion, a sealing portion protruded outwardly is not newly formed.

In the liquid storing pack, the first sealing portion may be provided at a position apart from the foldable portion.

According to this construction, since the first sealing portion is provided at the position apart from the foldable portion, the foldable portion in which the film is superposed several times does not overlap with the first sealing portion. For this reason, when the second sealing portion and the third sealing portion are formed, a problem that the first sealing portion superposes the end of the foldable portion to hinder the sealing does not occur.

In the liquid storing pack, the inner portion of the film and the liquid outlet portion may be made of a material capable of being thermally welded to each other, and the base end of the first sealing portion may be disposed so as to oppose a part of the liquid outlet portion.

According to this construction, the inner portion of the film and the liquid outlet portion are made of a material capable of being thermally welded to each other. In addition, the base end of the first sealing portion is opposed to a part of the liquid outlet portion. As a result, when forming the second sealing portion and the third sealing portion by the thermal welding, a gap can be removed by thermally welding the liquid outlet portion to the base end of the first sealing portion in which the gap can be easily generated. Therefore, it is possible to enhance the sealing property of the base end side of the first sealing portion.

According to another aspect of the present invention, there is provided a liquid container comprising a liquid storing pack having a liquid outlet portion through which liquid can be fed outwardly and a liquid storing bag portion made by a film and in fluid communication with the liquid outlet portion, the liquid storing pack being stored in a pack storage portion of the case, wherein the liquid storing bag portion of the liquid storing pack comprises a first sealing portion at which both end portions of one sheet of the film are bonded to each other, a body portion formed in a tube shape by the first sealing portion, a second sealing portion at which one opening of the body portion is sealed in a state where the liquid outlet portion is disposed inwardly of the one opening to hold the liquid outlet portion, and a third sealing portion at which the other opening of the body portion is sealed.

According to this construction, the first sealing portion at which both end portions of the film are bonded to each other is formed in the liquid storing bag portion of the liquid storing pack to be stored in the case. In addition, the second sealing portion at which one opening of the body portion formed in a tube shape by the first sealing portion is sealed in a state where the liquid outlet portion is disposed inwardly of the one opening and the third sealing portion at which the other opening of the body portion is sealed are formed in the liquid storing bag portion. Therefore, the liquid storing bag portion is formed in a bag shape by bending the film in a tube shape, sealing both end portions of the film, and sealing the openings, in place of bonding the ends of a plurality of films each other to form a bag shape. As a result, the sealing portions provided in the body portion can be smaller than those of the bag formed by bonding a plurality of films. That is, since the sealing portions protruded outwardly from the liquid storing bag portion can be reduced, it is possible to decrease the size of the liquid storing pack without decreasing the liquid volume. Therefore, since it is not necessary to secure a space for housing the sealing portions in the case, it is possible to efficiently store the liquid storing pack.

In the liquid container, a foldable portion (preferably, a gusset portion) formed by folding the body portion along a longitudinal direction may be provided as a side surface of the tube-shaped body portion.

According to this construction, since the foldable portion formed by folding the body portion along the longitudinal direction is provided in the body portion of the liquid storing bag portion, the liquid volume of the liquid storing bag portion can be relatively increased. Since the foldable portion is formed by folding the body portion in place of forming the foldable portion by bonding another film to the body portion, a sealing portion protruded outwardly is not newly formed.

In the liquid container, a pressing fluid inlet port for introducing a fluid pressing the liquid storing bag portion may be provided in the case.

According to this construction, the liquid container comprises the pressing fluid inlet port for introducing the fluid pressing the liquid storing bag portion in the case. For this reason, by introducing the fluid through the pressing fluid inlet port, the liquid storing bag portion can be pressed, so that it is possible to stably feed the liquid outwardly.

In the liquid container, the liquid storing pack may be stored in the case in a state where the first sealing portion faces the bottom surface of the case.

According to this construction, since the liquid storing pack is stored in the case in a state where the first sealing portion faces the bottom surface of the case, the first sealing portion is not protruded outwardly from the liquid storing pack in the case. For this reason, it is not necessary to provide a space for storing the sealing portion in the case.

According to another aspect of the present invention, there is provided a method of manufacturing a liquid storing pack having a liquid outlet portion through which liquid can be fed outwardly and a liquid storing bag portion made by a film and in fluid communication with the liquid outlet portion, the method comprises a first step of forming a tube-shaped body portion by bonding both end portions of the film to form a first sealing portion, a second step of sealing one opening of the body portion in a state where the liquid outlet portion is disposed inwardly of the one opening to hold the liquid outlet portion, and a third step of sealing the other opening of the body portion.

According to this method, when manufacturing the liquid storing pack, the body portion is formed by bonding both end portions of one sheet of the film in order to make the film a tube shape. One opening of the body portion is sealed in a state where the liquid outlet portion is disposed inwardly of the one opening and the other opening is sealed, thereby making the film a bag shape. Therefore, since the sealing portion can be formed smaller compared to the case where a plurality of films are sealed one another to form a bag shape, it is possible to simplify the sealing process.

In the method of manufacturing a liquid storing pack, each of the first sealing portion and the openings of the body portion may be bonded and sealed by thermal welding.

According to this method, since each of the first sealing portion and the openings of the body portion is bonded and sealed by thermal welding, the bonding and sealing can be performed more simply and the productivity can be enhanced.

The method of manufacturing a liquid storing pack may further comprise the step of forming a foldable portion (preferably, a gusset portion) in a side surface of the body portion by folding the body portion along a longitudinal direction.

According to this method, when manufacturing the liquid storing pack, the step of forming the foldable portion by folding the body portion along the longitudinal direction is further performed. In this step, since the foldable portion is formed by folding the body portion along the longitudinal direction in place of forming the foldable portion by attaching a new film to the body portion, the foldable portion can be formed more simply.

In the method of manufacturing a liquid storing pack, the first sealing portion may be provided at a position apart from the foldable portion in the first step.

According to this method, when manufacturing the liquid storing pack, the first sealing portion is provided at a position apart from the foldable portion. For this reason, the foldable portion and the first sealing portion are not overlapped. That is, in the second step or the third step, the foldable portion is provided, so that when the end portion where a film is superposed several times is sealed, the end portion does not overlap with the first sealing portion, thereby not hindering the sealing work.

In the method of manufacturing a liquid storing pack, an inner portion of the film, located at a base end of the first sealing portion, and the liquid outlet portion made of a material capable of being thermally welded to the inner portion may be thermally welded in a state where both are opposing each other, in the second step.

According to this construction, the inner portion of the film, located at the base end of the first sealing portion, and the liquid outlet portion are made of a material capable of being thermally welded to each other, and they are thermally welded in a state where the base end of the first sealing portion opposes to a part of the liquid outlet portion. For this reason, when sealing the opening by the thermal welding, a gap can be removed by thermally welding the liquid outlet portion to the film inner portion located at the base end of the first sealing portion in which the gap can be easily generated. Therefore, it is possible to enhance the sealing property of the base end side of the first sealing portion.

The present disclosure relates to the subject matter contained in Japanese patent application Nos. 2003-290826 and 2003-290829 (filed on Aug. 8, 2003), each of which is expressly incorporated herein by reference in its entirety.

DESCRIPTION OF THE PREFERRED EMBODIMENTS

First Embodiment

Figure 1:
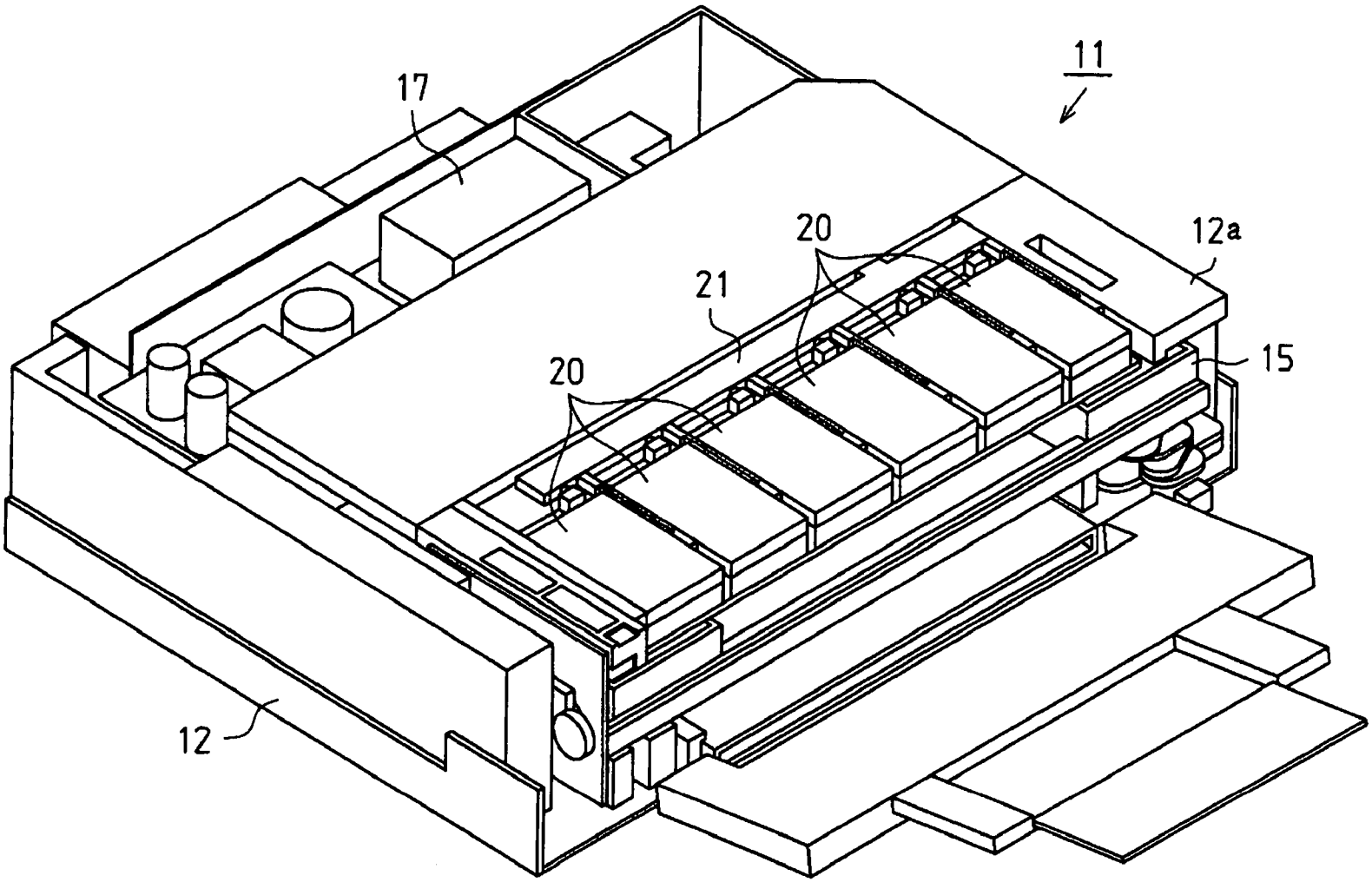
FIG. 1 is a perspective view of a printer according to a first embodiment.
Figure 2:
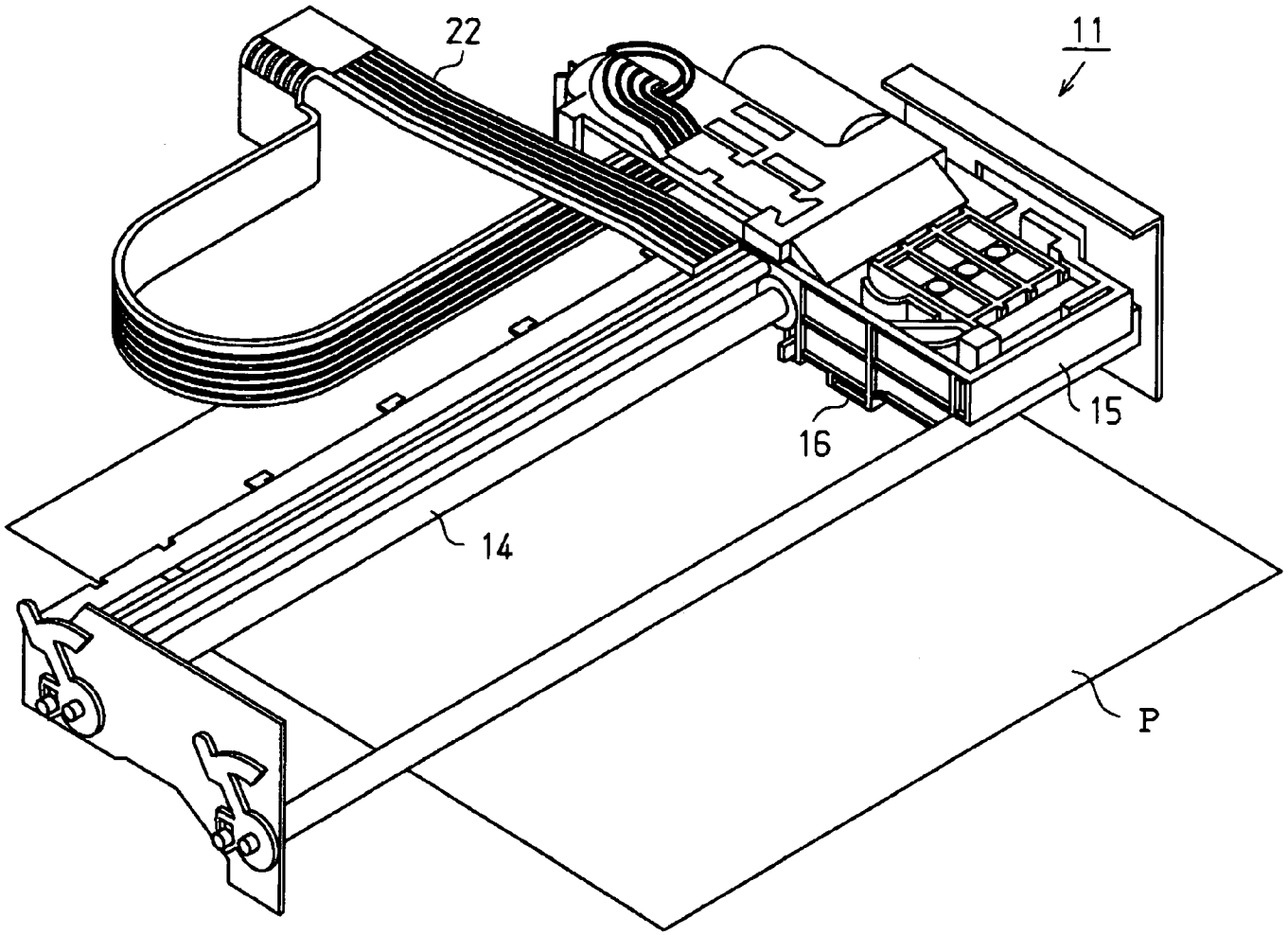
FIG. 2 is a perspective view of primary elements in the printer.
Figure 3:
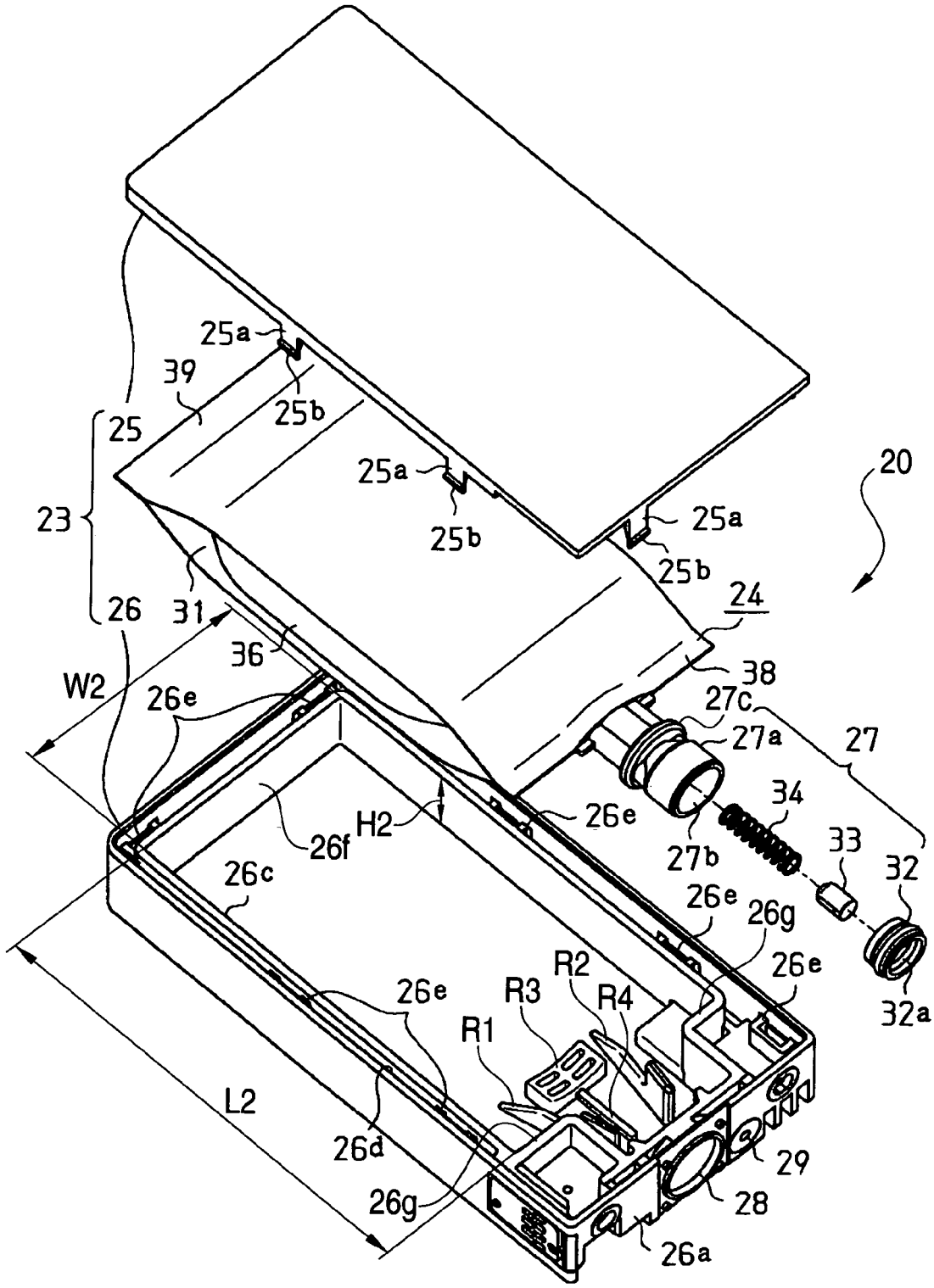
FIG. 3 is an exploded perspective view of an ink cartridge provided in the printer.

Hereinafter, a first embodiment of the present invention will be described with reference to FIGS. 1 to 11. FIG. 1 is a perspective view of an inkjet recording apparatus (hereinafter, referred to as printer 11) as a liquid ejecting apparatus according to this embodiment, and FIG. 2 is a perspective view of an important part of the printer 11. FIG. 3 is an exploded perspective view of an ink cartridge 20 provided in the printer 11.

As shown in FIG. 1, the printer 11 comprises a frame 12 having substantially a rectangular shape. As shown in FIG. 2, a guide shaft 14, a carriage 15, and a recording head 16 as a liquid ejecting head are provided inside the frame 12.

The guide shaft 14 is formed in a rod shape and installed inside the frame 12. The carriage 15 is penetrated by the guide shaft 14 to be relatively movable with respect to the guide shaft 14 and can be reciprocated. The carriage 15 is connected to a carriage motor via a timing belt (all are not shown) and can be reciprocated along the guide shaft 14 by the driving of the carriage motor.

The recording head 16 is provided on the bottom surface of the carriage 15 and comprises a plurality of nozzles (not shown) for ejecting ink as a liquid. The recording head 16 ejects the ink droplets onto a recording medium P as a target carried by a paper feed means not shown from the holes of the nozzles.

As shown in FIG. 1, a cartridge holder 12*a* is formed in the front surface of the frame 12. The cartridge holder 12*a* is provided detachably with ink cartridges 20 as liquid containers. In this embodiment, six ink cartridges 20 are provided in the cartridge holder 12*a* correspondingly to the number of kinds of ink to be used. As shown in FIG. 3, each ink cartridge 20 comprises an ink pack 24 as a liquid storing bag for storing ink as a liquid in a case 23. The ink pack 24 comprises a supply member 27 as a liquid outlet portion and a bag portion 31 (ink storing section) as a liquid storing portion made of a flexible film. The ink cartridges 20 mounted on the cartridge holder 12*a* are connected to a plate-shaped connection section 21 provided in the printer 11.

Six ink supply needles as liquid introducing members to be inserted into air passages and the supply members 27 and six ink paths connected to the ink supply needles are formed along the longitudinal direction in the connecting section 21 so as to correspond to the ink cartridges 20 (any of them is not shown). Each air passage of the connecting section 21 comprises a flow path connecting an air pressing pump 17 as pressing means provided in the printer 11 to the corresponding ink cartridge 20, and distributes the air fed from the air pressing pump 17 into the respective ink cartridges 20. The air which is a pressing fluid introduced into the respective ink cartridges 20 from the connecting section 21 flows in a gap between the case 23 and the ink pack 24. The pressure of the gap between the case 23 and the ink pack 24 is increased due to the inflow of air, so that the ink pack 24 is compressed. For this reason, the ink is extruded from the ink pack 24 and the extruded ink is fed to the respective ink supply needles formed in the connecting section 21 (see FIG. 1).

The respective ink paths formed in the connecting section 21 communicate with a supply tube 22 (see FIG. 2) connected to the connecting section 21. Six ink paths now shown are formed in the supply tube 22 formed in a belt shape correspondingly to the respective ink paths formed in the connecting section 21, and the ink paths connect the ink paths of the connecting section 21 to the recording head 16. Therefore, the ink fed to the connecting section 21 from the respective ink cartridges 20 is fed to the recording head 16 through the supply tube 22.

Next, the ink cartridges 20 will be described in detail.

Figure 4:
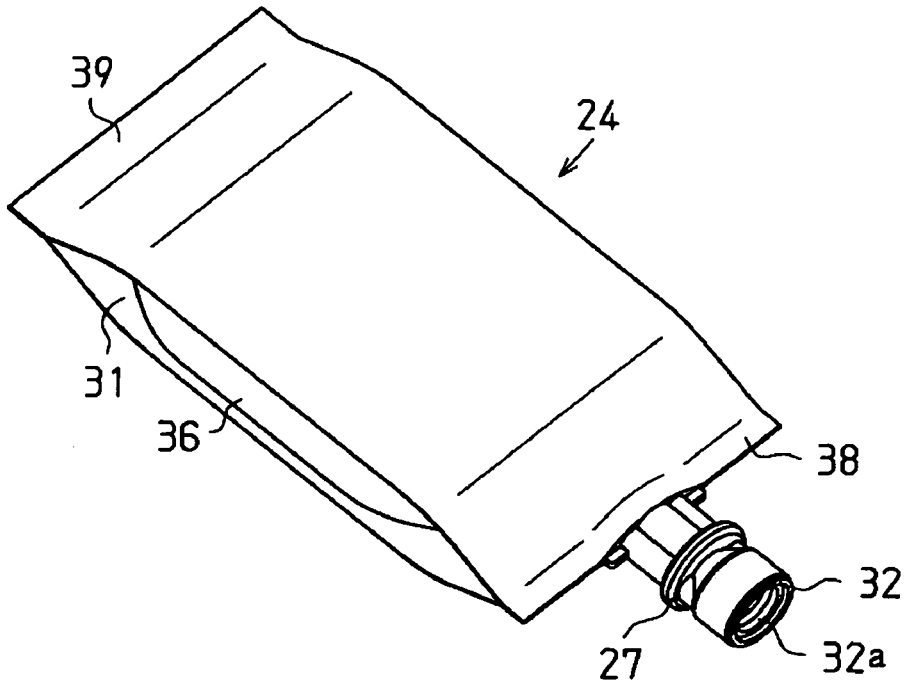
FIG. 4 is a perspective view of an ink pack of the ink cartridge.
Figure 5:
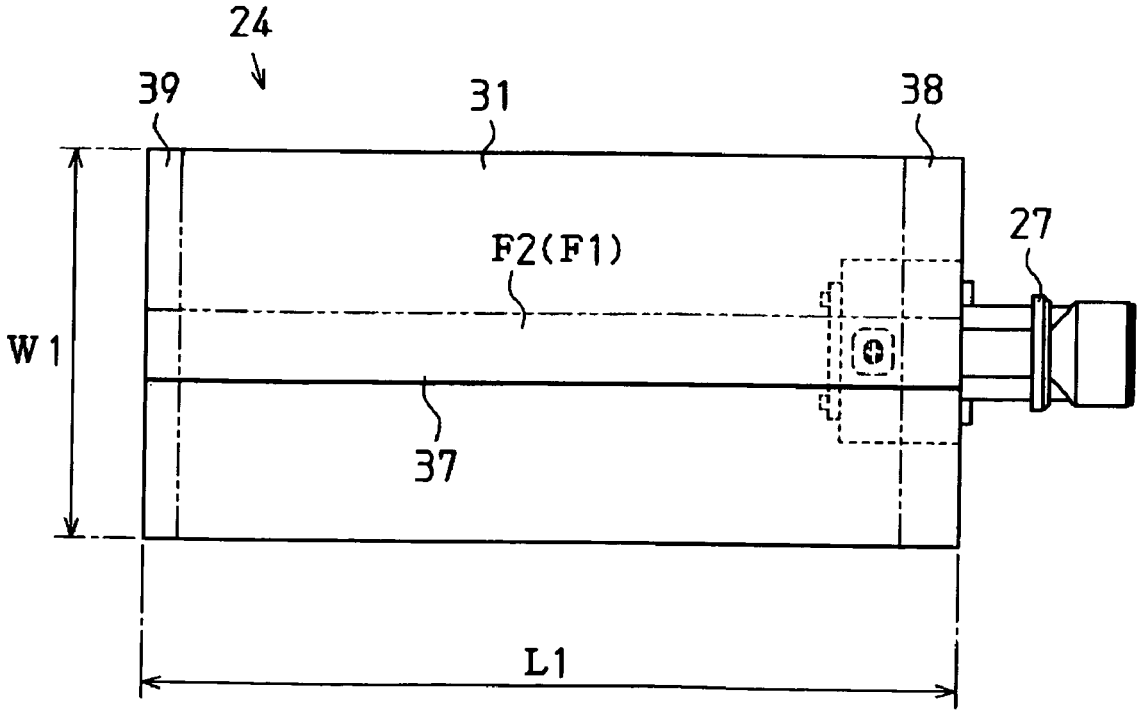
FIG. 5 is a bottom view of the ink pack.
Figure 6:
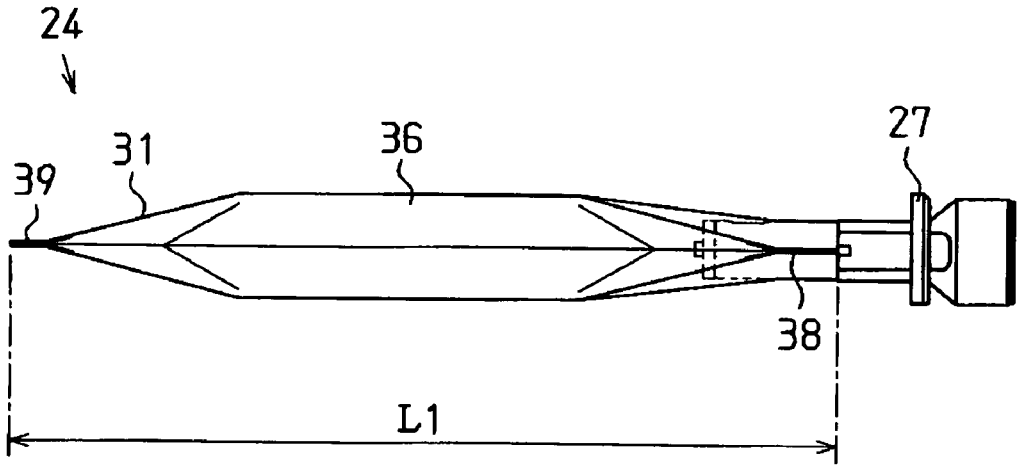
FIG. 6 is a side view of the ink pack.

As shown in FIGS. 3 to 5, the ink pack 24 provided inside the case 23 comprises a bag portion 31 as a body portion constituting the liquid storing portion, and the supply member 27 as the liquid outlet portion is protruded from one side of the bag portion 31. As shown in FIG. 3, the supply member 27 comprises a body 27*a* made of resin such as polypropylene, etc. and a supply hole 27*b* as a flow path for feeding the ink is formed to penetrate the body 27*a*. In the body 27*a*, one end is protruded from the bag portion 31, an ink outlet (not shown) formed at the other end is located inside the bag portion 31, and a supply-member welded portion 27*d* (see FIG. 8) flattened in the surface direction of the bag portion 31 is attached to the bag portion 31.

A sealing member 32 is fitted to the front end of the body 27*a* protruded from the bag portion 31. A supply hole 32*a* for emitting the ink is passed through the center of the sealing member 32. A spring seat 33 and a coil spring 34 are provided inside the supply hole 27*b* of the body 27*a*, which is a position further inside the sealing member 32. The coil spring 34 biases the spring seat 33 toward the sealing member 32, and as a result, the spring seat 33 closes the supply hole 32*a* of the sealing member 32. When the ink cartridge 20 is provided in the cartridge holder 12*a*, the ink supply needle not shown but provided in the connecting section 21 passes through the sealing member 32 in the supply member 27 and presses the spring seat 33 toward the bag portion 31 against the elastic force of the coil spring 34. If the spring seat 33 is pressed and separated from the sealing member 32, the ink in the bag portion 31 flows out through the gap between the sealing member 32 and the spring seat 33.

Figure 7:
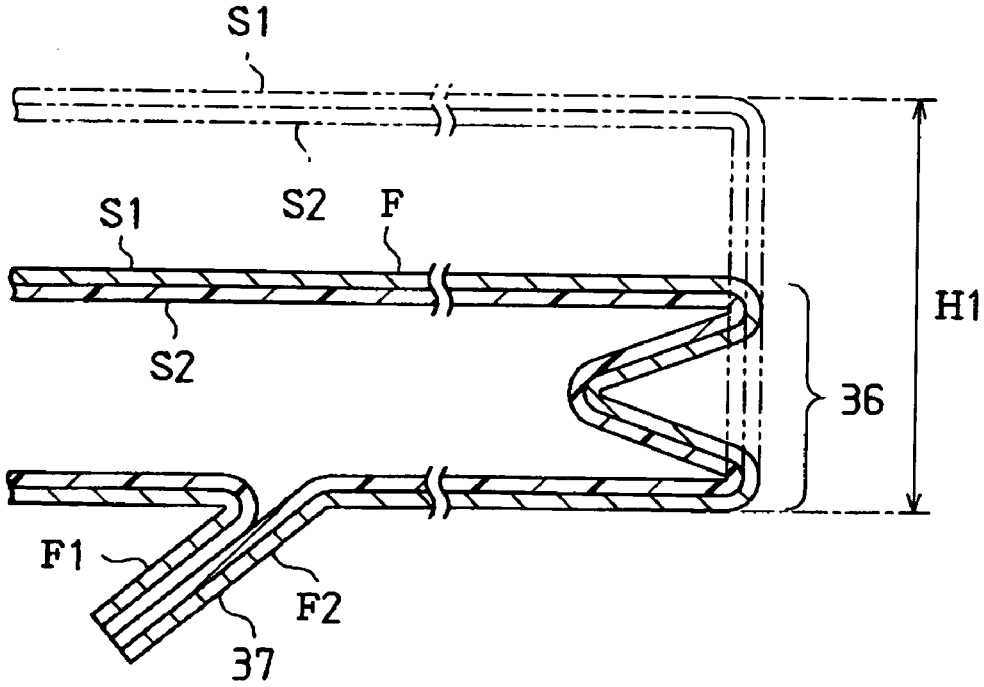
FIG. 7 is a cross-sectional view of a primary part of the ink pack.
Figure 9:
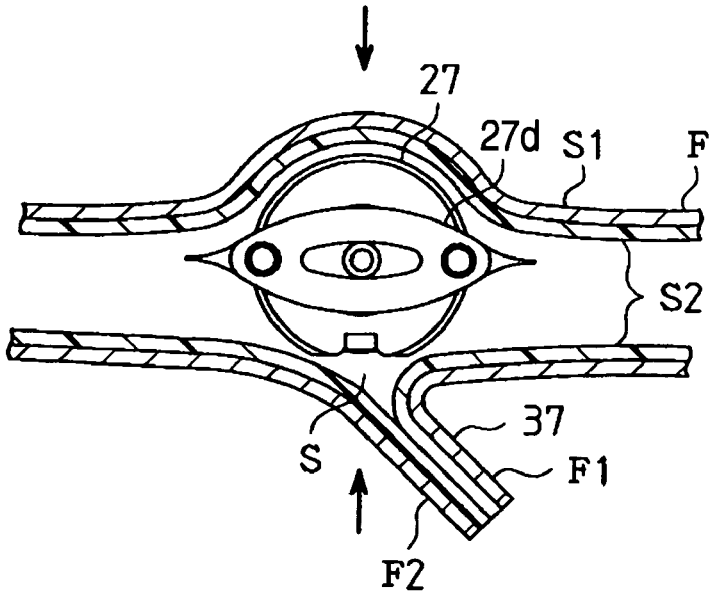
FIG. 9 is a cross-sectional view of a primary part of the ink pack.
Figure 10:
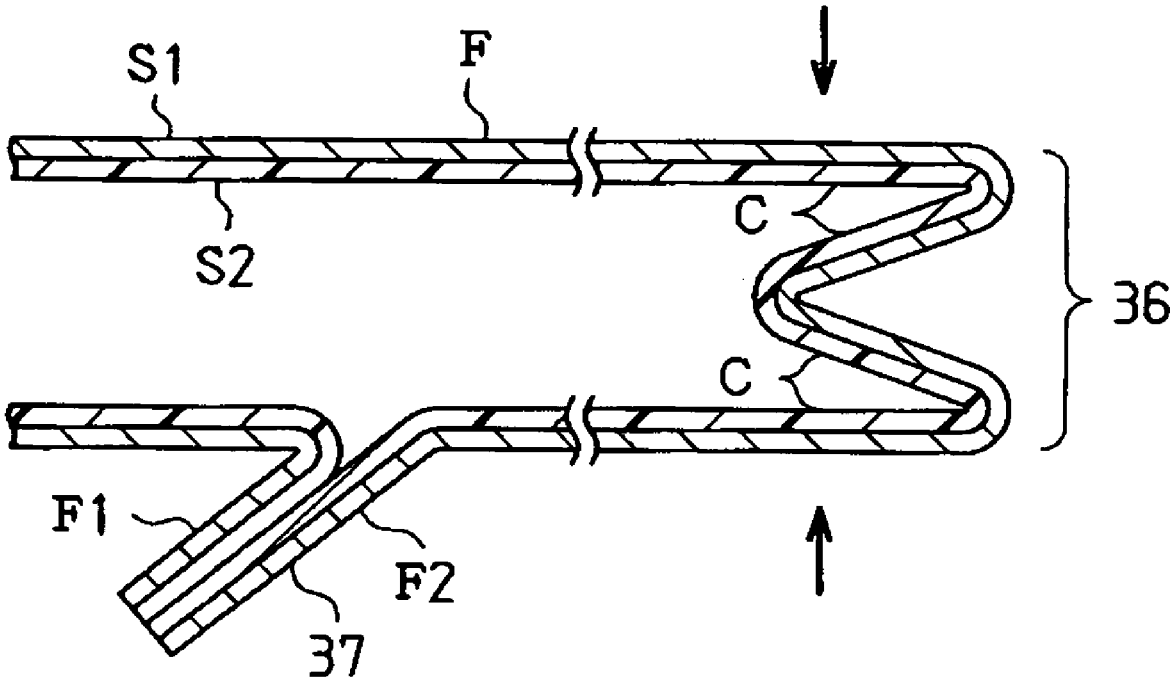
FIG. 10 is a cross-sectional view of a primary part of the ink pack.

As shown in FIGS. 7, 9, and 10, the bag portion 31 provided with the supply member 27 is made by one sheet of film F in which a plurality of layers is laminated. The film F comprises a gas barrier layer S1 in which a plurality of layers such as nylon, aluminum, etc. are laminated and a resin layer S2 in which a plurality of thermosetting resin layers such as polypropylene, polyethylene, etc. are stacked. The resin layer S2 is made of a material capable of being thermally welded to the body 27*a* of the supply member 27. As shown in FIG. 5, the bag portion 31 comprises the first welded portion 37. As shown in FIG. 7, the first welded portion 37 is formed by bending the film F into a tube shape with the gas barrier layer S1 facing outside and thermally welding the inner surfaces (resin layers S2) of both end portions F1 and F2 each other. As shown in FIG. 5, the first welded portion 37 extends along the longitudinal direction at the center of the bag portion 31 and is folded from its base end. When the ink pack 24 is stored in the case 23, the first welded portion 37 faces the bottom surface of the main body case 26. The first welded portion 37 corresponds to the first sealing portion in Claims.

Further, as shown in FIG. 5, the bag portion 31 comprises a second welded portion 38, which is indicated by the two-dotted line in the figure, sealing one opening of the film F bent into a tube shape in a state where the supply member 27 is inserted into the one opening. Furthermore, the bag portion 31 comprises a third welded portion 39, indicated by the two-dotted line in the figure, sealing the bottom portion of the bag portion 31. The second welded portion 38 and the third welded portion 39 correspond to the second sealing portion and the third sealing portion in Claims, respectively. The length of the bag portion 31 of the ink pack 24, that is, the length from the front end of the second welded portion 38 to the front end of the third welded portion 39 is denoted by the length L1. The width of the ink pack 24 is denoted by the width W1.

Figure 8:
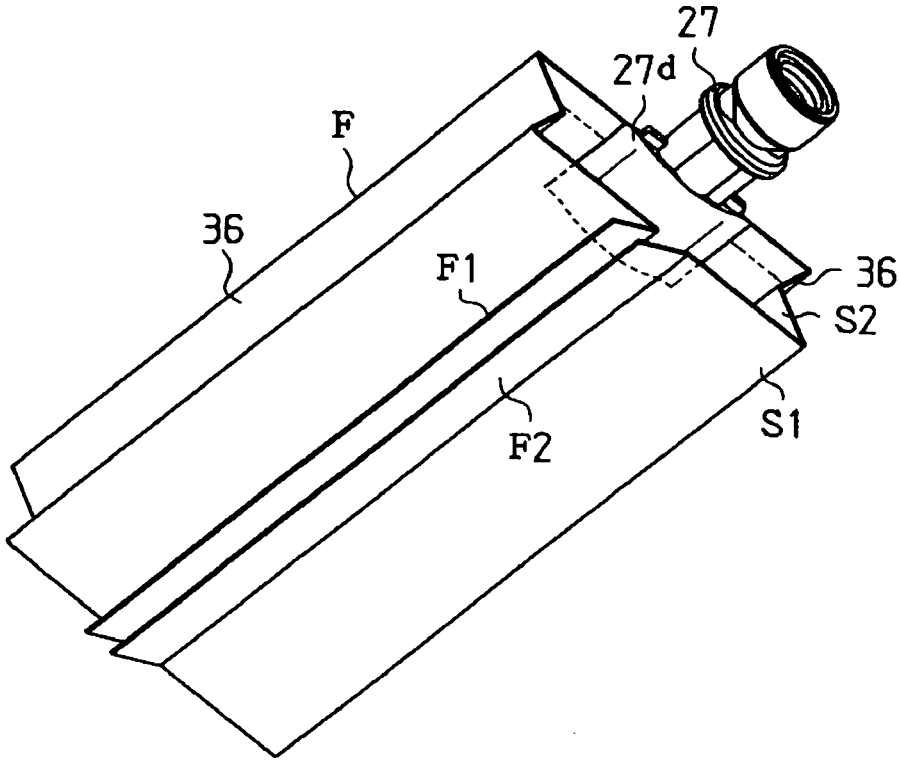
FIG. 8 is a perspective view illustrating a method of manufacturing the ink pack.

As shown in FIGS. 7, 8, and 10, the ink pack 24 has gusset portions 36 formed by folding the film F on both side surfaces of the bag portion 31 prior to forming the second welded portion 38 and the third welded portion 39. The gusset portions 36 are formed by forming a plurality of folded lines along the longitudinal direction in the bag portion 31, and have a cross-section of almost an M shape. The height (maximum height) of the bag portion 31 when the gusset portions are expanded, that is, the height of the ink pack 24 is denoted by H1. The volume of ink capable of being stored in the ink pack 24 (the bag portion 31) is denoted by the volume V1, and the ink having a volume smaller than the volume V1 is stored in the bag portion 31 of the ink pack 24 before use. For this reason, the ink pack 24 storing the ink has a relatively-low internal pressure, so that the film F is loosened. In other words, the film F is prevented from being expanded until it becomes a tight state by storing the ink in the ink pack 24 to the limit (to the volume V1).

As the ink pack 24 is filled gradually with the ink, the internal volume of the bag portion 31 is increased correspondingly to the quantity of the filled ink (the ink storing volume). Since the internal volume of the bag portion 31 can be increased due to the flexibility of the film constituting the bag portion 31 until the internal volume (the ink storing volume) of the bag portion 31 reaches the volume V1, the pressure acting on the ink stored in the ink pack 24 is increased smoothly (is almost constant). However, when the ink storing volume (the internal volume of the bag portion) exceeds the volume V1, the internal volume of the bag portion 31 can be increased only by expanding the film constituting the bag portion 31. For this reason, the ink stored in the ink pack 24 is subjected to the reaction to the elastic expansion of the bag portion 31, so that the pressure acting on the ink stored in the ink pack 24 is rapidly increased from the critical pressure P1 at the ink storing volume V1. In this embodiment, the ink having a volume smaller than the volume V1 is stored in the bag portion 31 of the ink pack 24, so that the pressure of the ink stored in the ink pack 24 is set to be lower than the critical pressure P1.

Next, a procedure of forming the film F in a bag shape will be described. When the film F is formed in a tube shape, as shown in FIG. 8, the film is bent in a tube shape with the gas barrier layer S1 facing outside, and then the gas barrier layers S1 are first heated by a pressing tool (not shown) in a state where both end portions F1 and F2 of the film is sandwiched. Then, the resin layers S2 of both end portions F1 and F2 are melted and solidified, so that the end portions F1 and F2 are bonded to form the first welded portion 37.

The film F having the tube shape is pressed by a metallic pattern (not shown), thereby forming a plurality of folded lines along the longitudinal direction. As a result, two gusset portions 36 are formed in the film F having the tube shape. As shown in FIGS. 7 and 10, the gusset portions 36 have a cross-section of an almost M shape. The gusset portions 36 are formed such that the first welded portion 37 is disposed between the gusset portions 36. That is, the first welded portion 37 is disposed at a position apart from the gusset portions 36.

As shown in FIG. 8, the end portion of one opening of the film F formed in the tube shape (end portion indicated by the two-dotted line in FIG. 7) is thermally welded in a state where one end portion of the supply member 27 of the sealing member 32 side is protruded from the bag portion 31 and the other end portion is inserted into the bag portion 31. At this time, in the side portions in which the gusset portions 36 are formed, as shown in FIG. 10, the film F has four folds and the resin layers S2 of the corner portions C are thermally welded by pressing and heating the film F in the arrow direction with the pressing tool. At this time, since the end portions of the gusset portions 36 are apart from the first welded portion 37, the thermal adhesion is performed without superposing the first welded portion 37 on the gusset portions 36 to make the film F six folds.

When thermally welding the opening of the supply member 27 side, as shown in FIG. 9, the thermal adhesion is performed by pressing and heating the film in the arrow direction with the pressing tool in a state where a gap S formed at the base end of the first welded portion 37 oppose the supply member welded portion 27*d* of the supply member 27. The gap S is generated by adhering the inner surfaces of the end portions F1 and F2 each other, folding the first welded portion 37 along the side surface of the bag portion 31, and superposing one end portion F2 on the other end portion F1. Since the gap S oppose the supply member welded portion 27*d*, the resin obtained by melting a part of the supply member welded portion 27*d* flows in the gap S during the thermal adhesion. As a result, the resin having flown in the gap is cooled and solidified, thereby closing the gap S. Moreover, FIG. 9 shows a laterally cross-sectional view of the ink pack 24 as seen from the bottom surface side of the ink pack.

The other opening of the tube-shaped film F is heated and sealed with the pressing tool after filling the inside with the ink, thereby forming the third welded portion 39. The ink pack 24 sealed using the thermal adhesion in this way is stored in the main body case 26 in a state where the first welded portion 37 faces down and the supply member 27 passes through a supporting slot 28 of the main body case 26. Then, the main body case 26 is sealed by locking the lid section 25 to the main body case 26 in a state where the film is bonded to the frame 26*c*.

Alternatively, the other opening of the tube-shaped film F may be sealed before filling the inside with the ink, thereby forming the third welded portion 39. In this case, it is preferable that the sealed ink pack 24 not filled with the ink is stored in the main body case 26, a film 30 is bonded to the frame 26*c*, the lid section 25 is locked to the main body case 26, and then the ink pack 24 is filled with the ink through the ink supply member 27. In this embodiment, since a valve structure comprising the coil spring 34 and the spring seat 33 is provided in the ink supply member 27, the supply hole 32*a* is allowed to communicate with the inside of the ink pack 24 by inserting the ink supply needle into the supply hole 32*a* of the sealing member 32 and moving the spring seat 33 against the accelerating force of the coil spring 34. In this state, the ink pack 24 stored in the case 23 can be filled with the ink through the ink supply needle inserted into the ink supply hole 32*a*. Since the bag portion 31 of the ink pack 24 is flexibly swelled to correspond to the shape of a storing portion (a closed space formed by the frame 26*c*, the bottom surface of the main body case 26, and the sealing film 30) of the ink cartridge 20 with the filling of ink by filling the ink pack 24 with the ink in a state where the ink pack 24 is stored in the case 23, the ratio of the ink volume to the volume of the storage portion, that is, the volume efficiency can be remarkably enhanced. In addition, the ink pack 24 may be filled with the ink while applying a negative pressure to the closed space through the air inlet 29.

As shown in FIG. 3, the case 23 housing the ink pack 24 comprises the lid section 25 and the main body case 26. The main body case 26 forms a box shape of which the top surface is opened. The supporting slot 28 constituting the storage portion is formed in the front surface 26*a* of the main body case 26. The supporting slot 28 connects the inside to the outside of the main body case 26. At the right side of the supporting slot 28 in the front surface 26*a* of the main body case 26, the air inlet 29 as the pressing fluid inlet connected to the air pressing pump 17 is formed in order to introduce the air into the gap between the case 23 and the ink pack 24. The air inlet 29 connects the inside to the outside of the main body case 26. The air inlet 29 serves as a flow passage which communicates with the air passage formed in the connecting section 21 and introduces the air into the gap between the case 23 and the ink pack 24, when the ink cartridge 20 is arranged in the cartridge holder 12*a*. Further, when the ink cartridge 20 is not arranged in the cartridge holder 12*a*, the air inlet is opened to communicate with the atmosphere, thereby not pressing the ink pack 24 due to variation of the internal pressure of the case 23.

The frame 26*c* constituting the storage portion is provided inside the main body case 26. The frame 26*c* constituting a closed space for pressing the ink pack 24 is provided at a position slightly apart from the inner surface of the main body case 26, and is formed in a shape having an opened top surface and a portion protruded toward the front surface 26*a* of the case 23 The frame 26*c* supports the ink pack 24 stored therein.The air inlet 29 is opened in the inner surface of the frame 26*c*.

A film (not shown) is bonded to the top end surface of the frame 26*c* housing the ink pack 24. For this reason, the space formed by the frame 26*c*, the bottom surface of the main body case 26, and the film is sealed substantially in a closed condition. The air fed from the air pressing pump 17 through the air inlet is introduced into the space.

A groove portion 26*d* is formed between the inner surface of the main body case 26 and the outer surface of the frame 26*c*. A plurality of first locking portions 26*e* are provided in the groove portion 26*d*. The first locking portions 26*e* have a rod shape installed between the frame 26*c* and the main body case 26 or a cross-section having almost a 'U' shape, and second locking portions 25*a* provided in the lid section 25 are locked in the first locking portions 26*e*.

The lid section 25 fitted into the main body case 26 has substantially a rectangular plate shape, and the second locking portions 25*a* are protruded in the edges toward the bottom from the lid section 25. The respective second locking portions 25*a* comprise claws 25*b* at the front end thereof. The claws 25*b* are protruded outwardly from the lid section 25, and can be respectively locked into the first locking portions 26*e* provided in the groove portion 26*d* of the main body case 26. The lid section 25 seals the opening of the main body case 26 in a state where the ink pack 24 is stored in the frame 26*c* and the film is bonded to the frame 26*c*.

The frame 26*c* supports the ink pack 24 stored therein. A pair of ribs R1 and R2 is formed on the bottom surface of the main body case 26 inside the frame 26*c*. The ribs R1 and R2 as supporting portions has a plate shape, are substantially vertically protruded from the bottom surface, and support the supply member 27 of the ink pack 24 stored in the frame 26*c*. More specifically, the supply member 27 which is positioned at the bag portion 31 side from a ring-shaped projection 27*c* formed on the outer circumference of the supply member 27 is inserted and fixed between the end portions of the supporting slot 28 side of the ribs R1 and R2, and thus the movement of the supply member 27 to the inside of the main body case 26 is regulated by the ribs R1 and R2 and the ring-shaped projection 27*c*. A supporting portion R3 is provided between the ribs R1 and R2. The supporting portion R3 has a flat shape and supports the supply member 27 of the ink pack 24 stored in the frame 26*c* from the bottom surface side.

A rib R4 as a supporting portion is provided between the ribs R1 and R2. The rib R4 is formed on the bottom surface of the main body case 26 to extend from the support R3 side to the supporting slot 28 side, and is locked with a concave portion which is not shown but formed in the ring-shaped projection 27*c*. By means of the locking of the rib R4 and the concave portion, the rotational position about the supply member 27 is determined, so that the deviation of the ink pack inside the case 23 is prevented from occurring.

The sealing film 30 (see FIG. 8) is bonded to the top surface of the frame 26*c* in a state where the ink pack 24 is stored therein. For this reason, the space formed by the frame 26*c*, the bottom surface of the main body case 26, and the sealing film 30 is sealed in a substantially closed state, and the air is introduced into the space through the air inlet 29.

The volume of the closed space is denoted by the volume V2. The ink volume V1 capable of being stored in the bag portion 31 of the ink pack 24 is set to be larger than the volume V2 of the closed space. The length from the inner surface of the wall portion 26*f* opposing the wall of the supporting slot 28 side of the frame 26*c* to the inner surface of the wall portion 26*g* is denoted by the length L2. The length L1 of the bag portion 31 of the ink pack 24 is set to be larger than the length L2. The width of the frame 26*c* is denoted by the width W2, and the width W1 of the ink pack 24 is larger than the width W2. The height of the frame 26*c*, specifically, the height from the bottom surface of the case 23 to the front end of the frame 26*c*, is denoted by the height H2, and the height H1 of the bag portion 31 of the ink pack 24 is set to be larger than the height H2.

Figure 11:
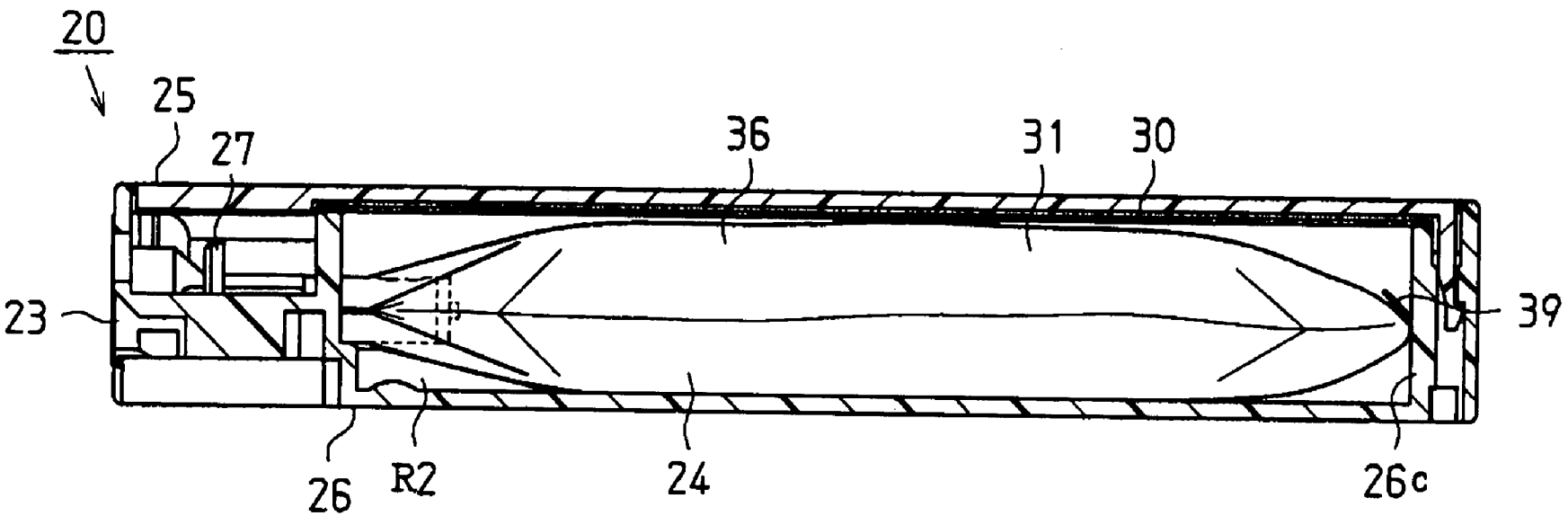
FIG. 11 is a cross-sectional view of the ink cartridge.

Therefore, the ink pack 24 is stored in the frame 26*c*, in a state where the bag portion 31 is curved or bent in the length L2 direction, the width W2 direction, and the height H2 direction of the frame 26*c*. At this time, as shown in FIG. 11, the ink pack 24 is stored in a state where the third welded portion 39 side is folded along the top surface of the bag portion 31. In this way, since the ink pack 24 has a shape corresponding to the inner wall of the case 23 inside the case 23, the ratio of the space occupied by the ink, that is, the volume efficiency can be enhanced.

When sealing the main body case 26, the ink pack 24 is stored in the frame 26*c* in a state where the first welded portion 37 faces the bottom surface of the main body case 26. Then, the sealing film 30 is bonded to the frame 26*c*. Furthermore, by locking the second locking portions 25*a* of the lid section 25 to the groove portions 26*d*, the lid section 25 is attached to the main body case 26.

According to the first embodiment, the following advantages can be obtained.

(1) In the first embodiment, the ink volume V1 capable of being stored in the bag portion 31 of the ink pack 24 is set to be larger than the volume V2 of the space formed by the frame 26*c*, the bottom surface of the main body case 26, and the sealing film 30. For this reason, even when the ink having almost the same volume as the volume V2 is stored in the bag portion 31 of the ink pack 24, the internal pressure of the ink pack 24 can be relatively decreased. Therefore, the ink pack 24 can be curved or bent, and thus can correspond to the shape of the space. For this reason, a ratio of the volume occupied by the ink with respect to the volume V2 in the case 23 with decrease of the unnecessary space, so that it is possible to efficiently store the ink in the case 23.

(2) In the first embodiment, the first welded portion 37 formed by thermally welding the inner surfaces of both end portions of the film F is provided in the ink pack 24. Further, the second welded portion 38 at which one opening of the tube-shaped film F is thermally sealed in a state where the supply member 27 is inserted in the film F is provided. Furthermore, the third welded portion 39 at which the other opening of the film F is sealed through the thermal adhesion is provided. For this reason, the welded portion protruded in the lateral direction can be reduced compared with the ink pack formed by bonding a plurality of films each other. As a result, in the case 23, the volume to be secured for the welded portion is reduced. Therefore, since the ink pack 24 can be compactly stored in the case, the ratio of the case 23 occupied by the ink can be enhanced.

(3) In the first embodiment, the length L1 of the bag portion 31 of the ink pack 24 is set to be larger than the length L2 from the inner surface of the wall portion 26*f* opposing the wall of the supporting slot 28 of the frame 26*c* to the inner surface of the wall portion 26*g*. Further, the width W1 of the bag portion 31 of the ink pack 24 is set to be larger than the width W2 of the frame 26*c*. Furthermore, by providing the gusset portions 36 in the side surfaces of the ink pack 24, the height H1 of the bag portion 31 of the ink pack 24 is set to be larger than the height H2 from the bottom surface of the case 23 to the front end of the frame 26*c*. For this reason, the bag portion 31 of the ink pack 24 stored in the frame 26*c* can be curved or bent and can have the shape corresponding to the shape of the lid section 25, so that the bag portion can be stored compactly. Therefore, an unnecessary space in the case 23 is removed, so that it is possible to enhance the ratio of the case 23 occupied by the ink.

(4) In the first embodiment, the ribs R1 and R2 are provided inside the frame 26*c* and on the bottom surface of the main body case 26. Further, the supporting portion R3 and the rib R4 are provided between the ribs R1 and R2. Therefore, since the supply member 27 of the ink pack 24 stored in the frame 26*c* is supported by the ribs R1, R2, R4 and the supporting portion R3, the ink pack 24 is prevented from being deviated. For this reason, it is possible to stably eject the ink from the ink pack 24.

(5) In the first embodiment, the first welded portion 37 at which the inner surfaces of both end portions F1 and F2 of the film F are thermally welded each other is provided in the ink pack 24. Further, the second welded portion 38 at which one opening of the tube-shaped film F is thermally sealed in a state where the supply member 27 is inserted between the film F is provided. Furthermore, the third welded portion 39 at which the other opening of the film F is sealed through the thermal adhesion is provided. For this reason, three welded portions are formed in the bag portion 31, so that it is possible to reduce the welded portions compared with the ink pack formed by bonding a plurality of films each other. As a result, since the welded portions protruded outwardly from the bag portion 31 are reduced and the volume of the ink to be stored is increased as much as possible, it is possible to decrease the size of the ink pack 24. Therefore, the space for housing the welded portions inside the case 23 can be reduced, so that it is possible to efficiently store the ink pack 24. Furthermore, since the welded portions are reduced, it is possible to simplify the process of thermally welding the end portions of the film F.

(6) In the first embodiment, the first welded portion 37 is disposed between the gusset portions 36 and is provided at a position apart from the gusset portions 36. For this reason, when the opening of the tube-shaped film F is sealed through the thermal adhesion to form the second welded portion 38 and the third welded portion 39, the first welded portion 37 and the gusset portions 36 folded are not overlapped. Therefore, since the heat can be easily delivered to the side portions (the gusset portions 36) of the opening side of the film F, it is possible to more surely perform the thermal adhesion.

(7) In the first embodiment, the base end of the first welded portion 37 is disposed to face the supply member 27. That is, the resin obtained by melting a part of the supply member 27 is allowed to flow in the gap S inside the base end of the first welded portion 37, thereby closing the gap S. Therefore, the sealing property of the second welded portion 38 can be secured.

(8) In the first embodiment, since the gusset portions 36 are provided in the ink pack 24, a capacity of the ink can be relatively increased. Further, since the gusset portions 36 are formed by folding the film F in place of forming the gusset portions by bonding another film to the bag portion 31, an welded portion protruded outwardly is not newly formed. Therefore, the gusset portions 36 can be formed without increasing the width or the height of the ink pack 24.

Second Embodiment

Figure 12:
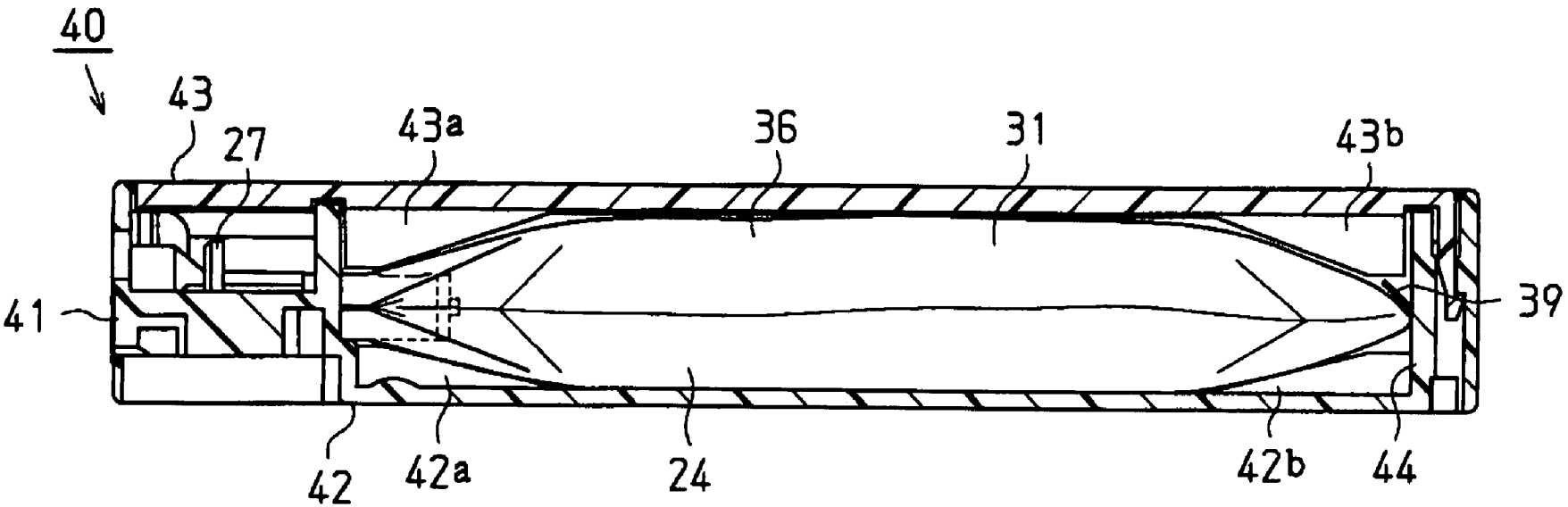
FIG. 12 is a cross-sectional view of an ink cartridge according to a second embodiment.
Figure 13:
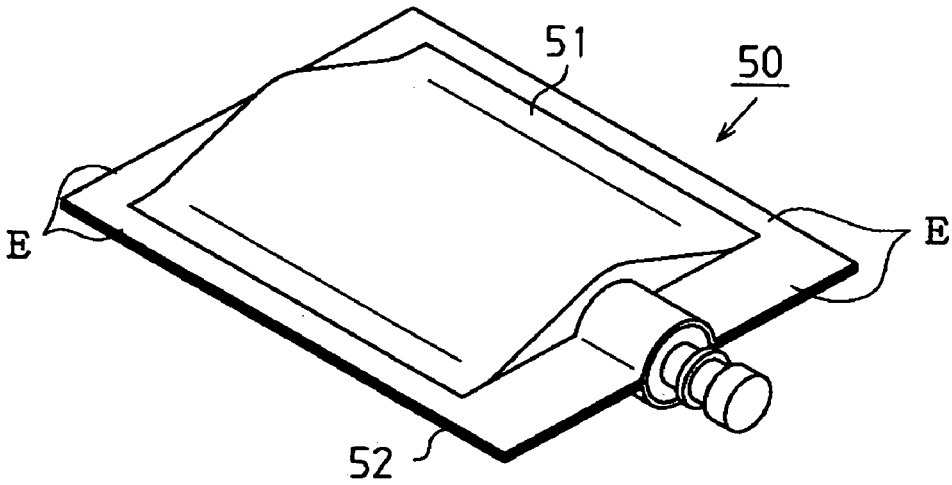
FIG. 13 is a perspective view of a conventional ink pack.
Figure 14:
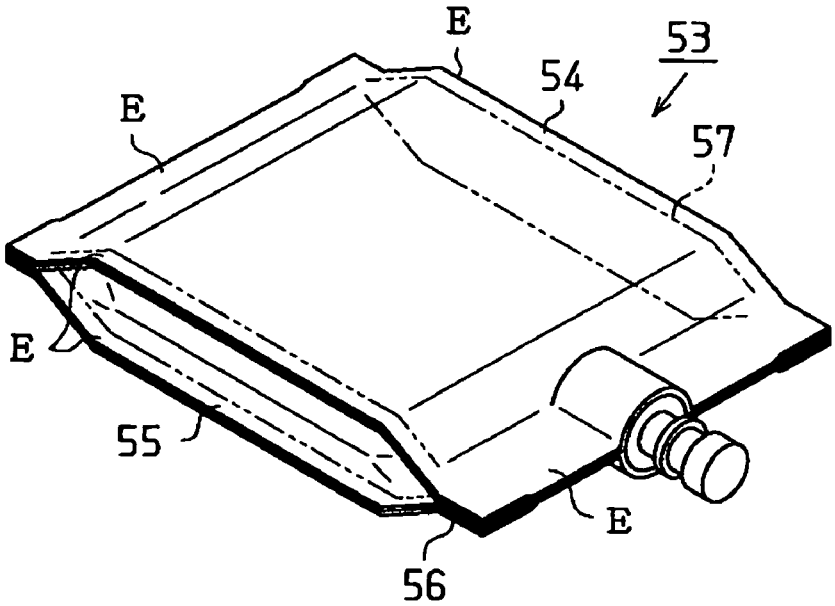
FIG. 14 is a perspective view of a conventional ink pack.

Next, a second embodiment of the present invention will be described with reference to FIG. 12. In the second embodiment, since only the structure of the case in the first embodiment is modified, detailed descriptions of the same elements as the first embodiment will be omitted. FIG. 12 shows a longitudinally (length direction) cross-sectional view of an ink cartridge 40.

As shown in FIG. 12, an ink cartridge 40 as a liquid container comprises a case 41. The case 41 comprises a main body case 42 of which the top surface is opened and a lid section 43 fitted to the main body case 42. A frame 44 constituting a closed space for pressing the ink pack 24 formed integrally with the main body case 42 is formed inside the main body case 42, and the ink pack 24 is stored in the frame 44. The volume V1, the length L1, the width W1, and the height H1 of the bag portion 31 of the ink pack 24 are set to be larger than the volume V2, the length L2, the width W2, and the height H2 of the closed space for housing the ink pack 24. For this reason, the ink pack 24 can be curved or the third welded portion 39 can be folded toward the top surface of the bag portion 31, so that the ink pack is stored correspondingly to the shape of the frame 44. The height H2 of the closed space means the length from the bottom surface of the case 41 to the front end of the frame 44.

Two pairs of ribs 42*a* and 42*b* as a supporting portion are formed in the bottom of the main body case 42. The ribs 42*a* and 42*b* have a plate shape, and extend in a direction substantially parallel to the longitudinal direction of the main body case 26. The ribs 42*a* and 42*b* are disposed to face each other on the bottom. The ribs 42*a* and 42*b* come in contact with the bag portion 31 of the ink pack 24 and support the ink pack 24. For the purpose of convenience, one pair of ribs 42*a* and 42*b* of the two pairs of ribs 42*a* and 42*b* is shown in FIG. 12.

Two pairs of ribs 43*a* and 43*b* as supporting portions are formed on the inner surface of the lid section 43. The ribs 43*a* and 43*b* have a plate shape, and extend in a direction parallel to the longitudinal direction of the main body case 26. The ribs 43*a* and 43*b* faces each other, and support the top surface side of the ink pack 24 stored in the frame 44 when the lid section 43 is fitted to the main body case 42. More specifically, the ribs 42*a* and 43*a* for fixing the supply member 27 side restrict the deviation of the supply member 27, because they fix the end portions of the bag portion 31 sandwiching the supply member 27. Further, for the purpose of convenience, one pair of ribs 43*a* and 43*b* of the two pairs of ribs 43*a* and 43*b* is shown in FIG. 12.

In the second embodiment, the ribs 42*a*, 42*b*, 43*a* and 43*b* are provided in the main body case 42 and the lid section 43, respectively. Therefore, since the ink pack 24 is supported by the ribs 42*a*, 42*b*, 43*a* and 43*b*, the ink pack can maintain a stable posture without moving inside the case 41, even when the bag portion 31 is curved or the third welded portion 39 is folded. More specifically, since the ribs 42*a*, 43*a* for fixing the supply member 27 side support the end portions of the bag portion 31 sandwiching the supply member 27, the deviation of the supply member 27 can be prevented. For this reason, the ink can be ejected from the ink pack 24.

In addition, the above embodiments may be modified as follows.

- Although the above embodiments have employed an air pressing method of pressing the ink pack 24 with the air introduced into the case 23 as an ink supply method of supplying the ink to the recording head 16 from the ink cartridge 20, other methods may be employed. For example, the ink may be fed from the ink pack 24 by providing a leaf spring in the case 23, driving the leaf spring with control means, and properly pressing the ink pack 24 with the leaf spring.
- In the above embodiments, the first welded portion 37 is formed by facing and thermally welding the resin layers S2 each other. Alternatively, for example, the first welded portion 37 may be formed by superposing the gas barrier layer S1 of one end portion F1 on the resin layer S2 of the other end portion F2. At this time, a new resin layer S2 may be partially deposited on the gas barrier layer S1 of one end portion F1 and the thermal adhesion may be performed with the resin layer S2 of the other end portion F2 opposed. Further, a part of the gas barrier layer S1 of one end portion F1 may be cut off and then the thermal adhesion may be performed with the resin layer S2 of the one end portion F1 and the resin layer S2 of the other end portion F2 superposed each other.

In the above embodiments, when fixing the end portions F1 and F2 and the openings of the bag portion 31, the thermal adhesion has been used. However, other sealing methods such as a fixing method using adhesive, a adhesion method using radio wave, etc. may be used to seal the end portions F1, F2 and the openings.

In the first embodiment, the supply member 27 is protruded from the bag portion 31 of the ink pack 24. Also, the volume V1, the length L1, the width W1, and the height H1 of the bag portion of the ink pack 24 is set to be larger than the volume V2, the length L2, the width W2, and the height H2 in the frame 44 of the main body case 26. Otherwise, the whole length of the ink pack 24 may be set to be larger than the length from the supporting slot 28 to the inner surface of the wall portion 26*f*. Alternatively, the ink pack may be constructed such that the supply member as the liquid outlet portion is not protruded from the bag portion and the volume, the length, the width, and the height of the bag portion (the whole ink pack) may be set to be larger than the volume, the length, the width, and the height of the storage portion for housing the ink pack. In brief, at least one of the volume, the length, the width, and the height of the bag portion as the liquid storing portion made by a film may be set to be larger than the volume, the length, the width, and the height of the storage portion which is provided inside the case and stores the bag portion.

In the second embodiment, two pairs of ribs 42*a* and 42*b* are provided in the main body case 42. In addition, two pairs of ribs 43*a* and 43*b* are provided in the lid section 43. Alternatively, a pair of ribs may be provided at the supply member 27 side of the main body case 42 or the opposite side thereof. Further, a pair of ribs may be provided at one end portion of the lid section 43. Alternatively, one or three or more ribs may be provided in the main body case 42 and the lid section 43, respectively, and the number of ribs is not limited to two pairs. Further, although the ribs 42*a*, 42*b*, 43*a* and 43*b* extend in a direction parallel to the longitudinal direction of the main body case 26, the ribs may extend in a direction substantially parallel to the lateral direction of the main body case 26.

Although the ink-ejecting printer 11 has been exemplified as a liquid ejecting device in the above embodiments, the liquid ejecting device is not limited to the ink ejecting printer. For example, as the liquid ejecting device, a printer including a facsimile, a copier, etc., a liquid ejecting device for ejecting a liquid such as an electrode material or a color material used for manufacturing a liquid crystal display device, an EL display device, a surface-discharge display device, etc., a liquid ejecting apparatus for ejecting a biological organic material used for manufacturing a biochip, a sample ejecting device as a precision pipet, and so on may be used. The fluid (liquid) is not limited to the ink, but other fluids (liquids) may be used.

What is claimed is:

1. A liquid storing pack to store liquid therein, comprising:

an outlet portion, configured to feed the stored liquid therefrom; and a bag portion, formed from one sheet of a film, the bag portion being in fluid communication with the outlet portion, and including:

two gusset portions, forming side faces of the bag portion, each said gusset portion having folded lines extending in a longitudinal direction of the bag portion;

a first sealing portion, at which both end portions of the one sheet of the film are bonded to each other to form a tubular body portion, the first sealing portion being located between the gusset portions;

a second sealing portion, at which one opening of the tubular body portion is sealed, thereby holding the outlet portion at an overlapping position that the first sealing portion overlaps with the second sealing portion; and a third sealing portion, at which the other opening of the tubular body portion is sealed, wherein:

the outlet portion is comprised of a resin material, and the film has a resin layer serving as an inner face of the body portion;

the gusset portions reach the second sealing portion so that the film maintains a four-fold state at the second sealing portion; and a part of the outlet portion and the resin layer are fused with each other at the overlapping position.

2. The liquid storing pack according to claim 1, wherein:

parts of the resin layer are fused with each other at the second sealing portion.

3. The liquid storing pack according to claim 1, wherein the liquid storing pack is configured and sized to mount within a liquid container including a case having a space accommodating the liquid storing pack.

4. The liquid storing pack according to claim 3, wherein the case has a pressurized fluid inlet port configured to introduce a pressurized fluid therethrough to pressurize the bag portion.

5. The liquid storing pack according to claim 3, wherein the liquid storing pack is accommodated in the case so that the first sealing portion faces a bottom face of the space.

* * * * *